United States Patent [19]

Odeh et al.

[11] Patent Number: 4,493,369

[45] Date of Patent: Jan. 15, 1985

[54] METHOD OF IMPROVED OIL RECOVERY BY SIMULTANEOUS INJECTION OF WATER WITH AN IN-SITU COMBUSTION PROCESS

[75] Inventors: Aziz S. Odeh, Dallas; Billy J. Dotson, Grand Prairie, both of Tex.

[73] Assignee: Mobil Oil Corporation, New York, N.Y.

[21] Appl. No.: 478,596

[22] Filed: Mar. 24, 1983

Related U.S. Application Data

[63] Continuation of Ser. No. 259,330, Apr. 30, 1981, abandoned.

[51] Int. Cl.[3] ..... E21B 43/243

[52] U.S. Cl. ..... 166/261; 166/269

[58] Field of Search ..... 166/261, 269, 272

[56] References Cited

U.S. PATENT DOCUMENTS

| | | | |
|---|---|---|---|
| 2,788,071 | 4/1957 | Pelzer | 166/261 |
| 2,994,375 | 8/1961 | Hurley | 166/261 X |
| 3,208,519 | 9/1965 | Moore | 166/261 |
| 3,448,807 | 6/1969 | Strickland, Jr. | 166/256 |
| 3,978,920 | 9/1976 | Bandyopadhyay et al. | 166/261 X |
| 4,042,026 | 8/1977 | Pusch et al. | 166/261 X |
| 4,166,504 | 9/1979 | Brown et al. | 166/272 |
| 4,252,191 | 2/1981 | Pusch et al. | 166/261 |
| 4,274,487 | 6/1981 | Hollingsworth et al. | 166/261 |

FOREIGN PATENT DOCUMENTS

| | | | |
|---|---|---|---|
| 1112956 | 5/1968 | United Kingdom | 166/272 |

*Primary Examiner*—George A. Suchfield

*Attorney, Agent, or Firm*—Alexander J. McKillop; Michael G. Gilman; Malcolm D. Keen

[57] ABSTRACT

A method of recovering heavy oil from a subterranean, permeable, heavy oil-bearing reservoir in which an oxygen-containing gas is injected into the lower portion of the reservoir to establish an in-situ combustion reaction therein and to form a combustion front near the injection well. Injection of the oxygen-containing gas is continued to advance the combustion front that heats the oil and generates gas to displace the oil through the reservoir toward a producing well. Water is injected into the upper portion of the reservoir during combustion to prevent gases from migrating into the upper portion of the reservoir, scavenge heat from the burned out portion of the reservoir, and displace oil from the reservoir, particularly the lower region, toward a production well. The areal sweep efficiency of the injected water may be improved by the addition of thickening agents and water-soluble polymers.

8 Claims, 1 Drawing Figure

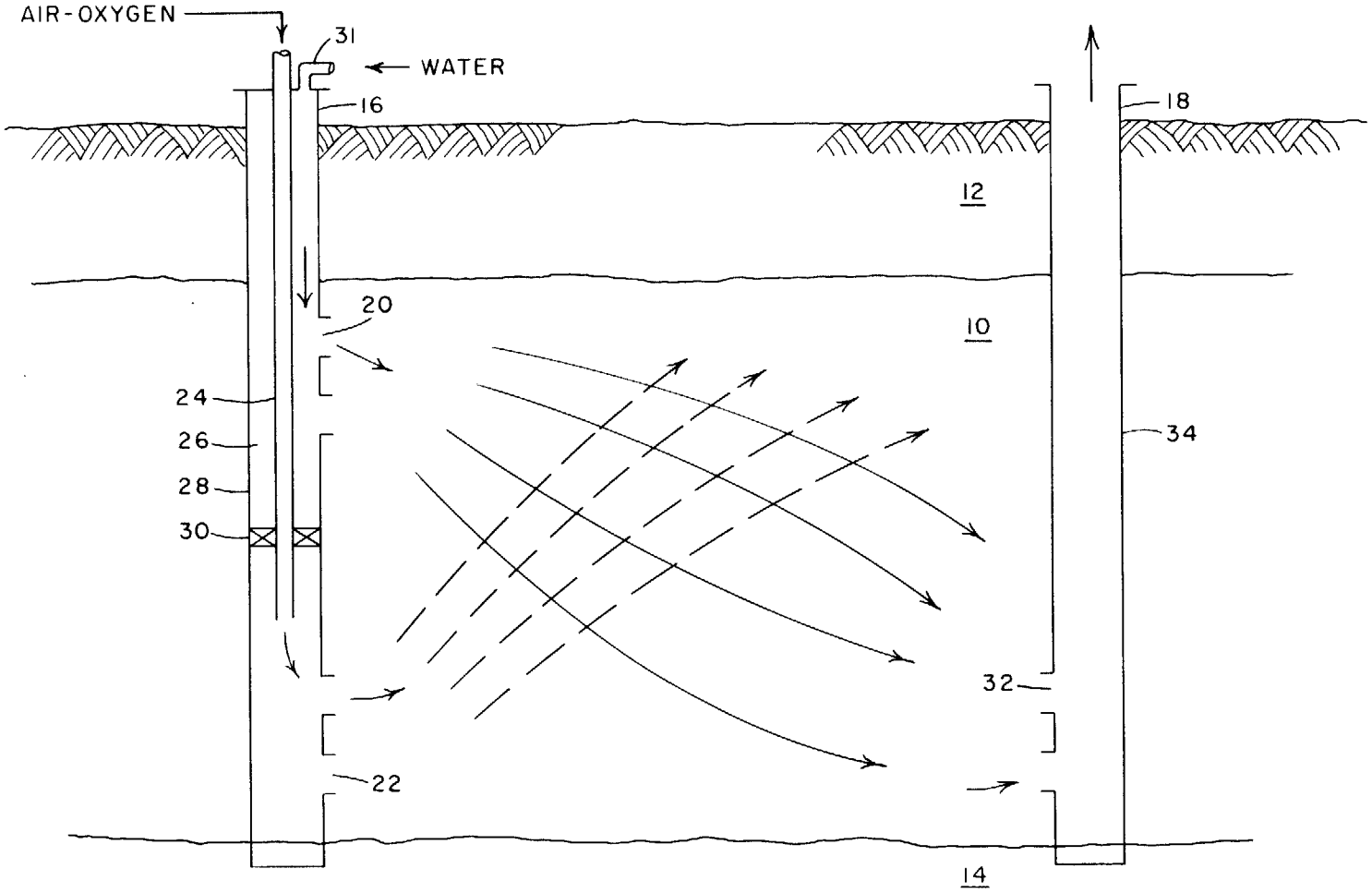
18
34
12
10
32
14
WATER
31
16
20
22
AIR-OXYGEN
24
26
28
30

METHOD OF IMPROVED OIL RECOVERY BY SIMULTANEOUS INJECTION OF WATER WITH AN IN-SITU COMBUSTION PROCESS

This is a continuation of copending application Ser. No. 259,330, filed Apr. 30, 1981, now abandoned.

BACKGROUND OF THE INVENTION

1. Field of the Invention

This invention concerns a thermal oil recovery method utilizing in-situ combustion and water in a method which permits efficient recovery of heavy oil from permeable, heavy oil-bearing reservoirs.

2. Background and Prior Art

It has been proposed to recover oil, in the nature of heavy viscous oils, from a subterranean reservoir by a method which is commonly known as in-situ combustion. In this method, an oxygen-containing gas is injected into the reservoir through an injection well with ignition of oil within the adjacent reservoir initiated by suitable means for establishing a combustion front. The reservoir is usually provided with one or more production wells for the production of oil. As the flow of oxygen-containing gas to the reservoir is continued, the combustion front is moved from the injection well toward the production wells. The heat generated by burning reduces the viscosity of the oil which is displaced before the combustion front toward the production wells from which the oil is recovered. The combustion front in displacing the mobile oil before it in the reservoir uses the residual carbonaceous deposit as fuel.

In these processes, the gaseous combustion products and light hydrocarbons are considerably lighter than the oil and water present in the reservoir and thus, because of gravity segregation, tend to rise to the top of the reservoir when vertical communication exists. Consequently, these products channel through the top of the formation to the producing well overriding a major portion of the reservoir and contacting only a small fraction of the reservoir oil. This behavior results in inefficient oil recovery and low vertical sweep efficiency.

Furthermore, in such in-situ combustion processes, large quantities of heated rock are left behind in the reservoir. This heat is therefore lost, which greatly reduces the thermal efficiency of the process.

Our improved invention provides a substantial advance in recovering heavy oil from permeable, heavy oil-bearing reservoirs utilizing in-situ combustion.

SUMMARY OF THE INVENTION

According to the present invention, we have found an improved method for recovering oil, especially viscous or heavy oil, from a permeable, heavy oil-bearing reservoir wherein in-situ combustion is established in the lower portion of the reservoir, water is injected into the upper portion of the formation at controlled rates and oil is recovered at a production well. An oxidizing gas such as air or oxygen or mixtures thereof is injected into the lower portion of the reservoir to form a combustion front which advances through the reservoir toward a production well. Heat generated by the in-situ combustion reaction heats the viscous oil as it advances through the reservoir thereby reducing its viscosity. The water injected above the in-situ combustion front, with a higher density, tends to segregate to the bottom of the reservoir because of gravitational forces, whereas the low density products of combustion tend to segregate to the top. In addition to very effective contact and heat exchange between the water and the gaseous products of combustion, the water tends to fill gas-swept channels thus impeding the flow of gases and diverting them to previously unswept paths resulting in higher vertical sweep efficiency. The water passing through the combustion-heated formation scavenges heat and becomes a hot water drive displacing oil from lower regions, not subjected to combustion, which further improves recovery efficiency per BTU of heat injected. This type of vertical crossflow of fluids within a reservoir enables the reservoir to be more efficiently heated over the areal extent of the reservoir thereby greatly enhancing the recovery of oil. Mobility control agents such as thickeners and water-soluble polymers may be added to the injected water to improve its areal sweep efficiency.

BRIEF DESCRIPTION OF THE DRAWING

The drawing is a view in cross-section of an injection well and a production well penetrating a subterranean, permeable, heavy oil-bearing reservoir illustrating the invention.

DESCRIPTION OF THE PREFERRED EMBODIMENTS

Thus, according to the drawing, a subterranean, permeable, heavy oil-bearing reservoir 10, is overlain by overburden 12 and underlain by basement formation 14. The reservoir 10 is penetrated by an injection well 16 and a production well 18.

The injection well 16 has perforations 20 providing fluid communication into the upper portion of reservoir 10 and perforations 22 providing fluid communication into the lower portion of the reservoir. A tubing string 24 extends from the earth's surface to the lower portion of reservoir 10 forming an annulus 26 between the tubing string and injection well casing 28.

A packer 30 seals the outer tubing surface from the inside of casing 28. The top of injection well 16 is provided with a means 31 for injecting fluid into the annular space 26 between tubing 24 and casing 28.

The production well 18 has perforations 32 providing fluid communication into the lower portion of reservoir 10 for the production of oil and gases through conduit 34 to the surface of the earth.

According to one presently preferred mode of operation, the lower portion of the oil-bearing reservoir 10 is ignited in the vicinity of perforations 22. After ignition, an oxygen-containing gas such as oxygen or air or mixtures thereof is injected through tubing string 24 into the lower portion of the reservoir through perforations 22. A combustion front is formed which progressively advances from the injection well to the production well. After the combustion front has advanced a sufficient distance, water is injected through injection means 31 into the annulus 26 formed between casing 28 and tubing 24 and outwardly through perforations 20 and into the upper portion of the reservoir 10.

The water, with a higher density, tends to segregate to the bottom of the formation because of gravitational forces, whereas the low density combustion gases tend to segregate to the top. The water tends to fill gas-swept channels thus impeding the flow of gas and diverting them to previously unswept paths resulting in higher vertical sweep efficiency. The water passing through the combustion-heated reservoir scavenges heat and becomes a hot water drive displacing oil from lower regions of the reservoir, not subjected to combustion, which further improves recovery efficiency.

The combustion front and water advance through the reservor 10 contacting the oil and reducing its viscosity and displacing the oil towards production well 18. Admixtures of oil and gases enter production well 18 through the lower perforations 32, pass up through conduit 34 and are recovered at the surface of the earth.

Once the combustion front is sufficiently near to the production well which can be ascertained by a rise in the temperature at the production well, further injection of the oxidizing gas is discontinued. Water injection may be continued until water breaks through at the production well 18.

Water may be injected with the oxygen-containing combustion supporting gas after the initiation of in-situ combustion so as to absorb heat from the combustion zone, which is a technique known in the art as wet combustion. The amount of water injected, in relation to the oxygen-containing combustion supporting gas, will vary depending upon the amount necessary to keep the reservoir below excessive temperature levels. It must not be so great, of course, as to extinguish combustion as would be evidenced by the composition of the gases produced from the reservoir.

The oxygen-containing gas used to support combustion can be air, substantially pure oxygen, or oxygen-enriched air.

The amount of water injected into the upper portion of the reservoir is much larger than that used in conventional wet combustion processes in order to scavenge sufficient heat from the burned out portion of the reservoir and also to restrict gas flow in the burned zone. However, the injection rate must be controlled or intermittently discontinued to prevent the water from overriding the combustion front or extinguishing it.

In another embodiment of the invention, separate injection wells may be used for the injection of the oxidizing gas such as air or oxygen and water into the selected portions of the reservoir. For example, two or more closely spaced injection wells may be used with air or oxygen injected near the bottom of the reservoir through one well and water injected near the top of all, or selected, separate wells as dictated by preferred engineering practices.

In another embodiment of the process of this invention, the areal sweep efficiency of the water injected into the upper portion of the reservoir may be improved by the addition thereto of mobility control agents such as thickeners or water-soluble polymers. These agents increase the viscosity of the water which decrease its mobility with a resulting increase in displacement efficiency. Examples of useful thickeners and water-soluble polymers useful in connection with this process are disclosed in U.S. Pat. No. 3,500,918 to Holm and U.S. Pat. No. 3,710,861 to Steeg, the disclosures of which are hereby incorporated by reference.

The present invention may be carried out utilizing any suitable injection and production system. The injection and production systems may comprise one or more wells extending from the surface of the earth into the oil-bearing formation. Such injection and production wells may be located and spaced from one another in any desired pattern. For example, a line drive pattern may be utilized in which a plurality of injection wells are arranged in a more or less straight line toward a plurality of production wells in a more or less straight line parallel to a line intersecting the plurality of injection wells. In addition, a circular drive pattern may be used in which the injection system comprises a central injection well and the production system comprises a plurality of production wells about the injection well in a ring pattern such as a 5-spot or 7-spot well pattern.

We claim:

1. A method for recovering heavy oil from a subterranean, permeable, heavy oil-bearing reservoir penetrated by an injection well and a production well, comprising:

(a) establishing a burning zone in the lower portion of said reservoir at the face of said injection well;

(b) injecting an oxygen-containing gas into the lower portion of said reservoir via said injection well to move said burning zone toward said producing well and to generate hot combustion gases;

(c) injecting a sufficient amount of water via an injection well into the upper portion of said reservoir to impede the flow of said hot combustion gases through the upper portion of the reservoir, to scavenge heat from the burned out portion of the formation, and to displace the oil through said reservoir towards the lower end of said production well; and (d) recovering fluids including oil solely from the lower portion of said reservoir via said production well.

2. A method for recovering heavy oil from a subterranean, permeable, heavy oil-bearing reservoir penetrated by an injection well and a production well, comprising:

(a) establishing a burning zone in the lower portion of said reservoir at the face of said injection well;

(b) injecting an oxygen-containing gas into the lower portion of said reservoir via said injection well to move said burning zone toward said producing well and to generate hot combustion gases that reduce the viscosity of the oil and displace the oil through said reservoir toward said production well;

(c) injecting a sufficient amount of water via an injection well into the upper portion of said reservoir to impede the flow of said hot combustion gases through the upper portion of the reservoir, to mix with the uprising hot combustion gases so as to scavenge heat therefrom without extinguishing the combustion front thereby producing a hot water drive for displacing oil from lower regions of the reservoir, to scavenge heat from the burned out portion of the formation, and to displace the oil through said reservoir towards the lower end of said production well;

(d) continuing injecting water and oxygen-containing gas into the injection well and producing fluids solely from the lower portion of said reservoir through said production well until the burning zone of the in-situ combustion operation is near the production well;

(e) thereafter discontinuing injecting the oxygen-containing gas into the injection well to discontinue in-situ combustion and continuing injecting water into the upper portion of the formation via the injection well; and (f) continuing to produce fluids from the lower portion of the reservoir via the production well until breakthrough of the water at the production well.

3. The method as defined in claim 2 wherein said oxygen-containing gas is air.

4. The method as defined in claim 2 wherein said oxygen-containing gas is oxygen-enriched air.

5. The method as defined in claim 2 wherein said oxygen-containing gas is substantially pure oxygen.

6. The method as defined in claim 2 wherein said water injected into the upper portion of the reservoir is increased in viscosity by the addition of a thickening agent.

7. The method as defined in claim 2 wherein said water injected into the upper portion of the reservoir is increased in viscosity by the addition of a water-soluble polymer.

8. The method as defined in claim 2 wherein the injection of water in step (c) is periodically terminated.

* * * * *